United States Patent [19]

Tahara

[11] Patent Number: 4,844,371

[45] Date of Patent: Jul. 4, 1989

[54] APPARATUS FOR CONTROLLING TENSION OF A SHEET

[75] Inventor: Yoshinori Tahara, Numazu, Japan

[73] Assignee: Mei San Co., Ltd., Shizuoka, Japan

[21] Appl. No.: 113,357

[22] Filed: Oct. 23, 1987

Related U.S. Application Data

[63] Continuation of Ser. No. 830,960, Feb. 19, 1989, abandoned.

[30] Foreign Application Priority Data

Feb. 27, 1985 [JP] Japan ..... 60-38349

[51] Int. Cl.[4] ..... B65H 23/04

[52] U.S. Cl. ..... 242/75.44; 242/75.47

[58] Field of Search ..... 242/75.43, 75.44, 75.45, 242/75.46, 75.47

[56] References Cited

U.S. PATENT DOCUMENTS

| | | | |
|---|---|---|---|
| 2,964,826 | 12/1960 | Klein et al. | 242/75.45 X |
| 3,289,959 | 12/1966 | Scher | 242/75.44 X |
| 4,199,118 | 4/1980 | Tetro et al. | 242/75.44 |
| 4,286,757 | 9/1981 | Wirth | 242/75.44 |
| 4,347,993 | 9/1982 | Leonard | 242/75.44 X |

FOREIGN PATENT DOCUMENTS

| | | | |
|---|---|---|---|
| 3049166 | 7/1982 | Fed. Rep. of Germany | 242/75.44 |

*Primary Examiner*—Daniel P. Stodola

*Attorney, Agent, or Firm*—Darby & Darby

[57] ABSTRACT

An apparatus for controlling a tension of a sheet delivered from a rotatable sheet roll includes a brake device including a shaft connectable to the sheet roll for rotation therewith, a brake disc fixedly mounted on the shaft, and a friction member rotatably mounted on the shaft. The apparatus further includes a device for urging the friction member against the brake disc to apply a braking force thereto, a member operatively connected to the friction member for limiting the rotation of the friction member, a sensor for measuring a reaction force exerted on the rotation limiting member when the friction member is urged against the brake disc to produce a first measurement signal, a sensor for detecting a rotational speed of the sheet roll to produce a second measurement signal, a sensor for detecting the amount of delivery of the sheet from the sheet roll to produce a third measurement signal, and a microprocessor unit programmed to be responsive to the first, second and third measurement signals to calculate the tension of the sheet. The microprocessor unit is programmed to determine a difference between the calculated tension and a reference tension to output information representative of the tension difference. The urging device is responsive to the information from the microprocessor unit to adjust the urging of the friction member against the brake disc so that the calculated tension coincides with the reference tension.

3 Claims, 5 Drawing Sheets

APPARATUS FOR CONTROLLING TENSION OF A SHEET

This is a continuation, of application Ser. No. 830,960, filed Feb. 19, 1986, now abandoned

BACKGROUND OF THE INVENTION

1. Field of the Invention

This invention relates to an apparatus for controlling a tension of a sheet delivered from a reel or the like.

2. Prior Art

Generally, a tension of a sheet delivered from a reel, for example, of a sheet cutter, a winder or the like, is measured, and in accordance with the measured tension, a braking force applied to a shaft of the reel around which the sheet is wound is adjusted, thereby controlling the tension of the sheet to the optimum level. The tension of the sheet is measured through a torque exerted on the shaft of the reel. Sensors for measuring such torque are disclosed in Japanese Patent Application Nos. 57-42424, 57-196192 and 57-220549. However, with the conventional tension control apparatus employing such torque sensor, the tension control of the sheet can be carried out satisfactorily only when the sheet is delivered from the reel at a constant speed or when the speed of delivery or movement of the sheet is changed quite gradually. And, when the delivery speed is changed abruptly, that is to say, the sheet is subjected to undue acceleration or deceleration, the tension of the sheet can not be controlled properly due to the moment of inertia ($GD^2$) of the roll of sheet wound around the reel.

SUMMARY OF THE INVENTION

It is therefore an object of this invention to provide an apparatus for controlling a tension of a sheet which is capable of accurately controlling the sheet tension even when the speed of movement of the sheet is changed.

According to the present invention, there is provided an apparatus for controlling a tension of a sheet delivered from a rotatable sheet roll, said apparatus comprising:

(a) a brake device comprising a shaft connectable to the sheet roll for rotation therewith, a brake disc fixedly mounted on said shaft, and friction means rotatably mounted on said shaft;

(b) means for urging said friction means against said brake disc to apply a braking force thereto;

(c) means operatively connected to said friction means for limiting the rotation of said friction means;

(d) means for measuring a reaction force exerted on said rotation limiting means when said friction means is urged against said brake disc to produce a first measurement signal;

(e) means for measuring a rotational speed of the sheet roll to produce a second measurement signal;

(f) means for measuring the amount of delivery of the sheet from said sheet roll to produce a third measurement signal; and (g) a microprocessor unit programmed to be responsive to said first, second and third measurement signals to calculate the tension of the sheet, said microprocessor unit being programmed to determine a difference between said calculated tension and a reference tension to output information representative of said tension difference;

(h) said urging means being responsive to said information to adjust the urging of said friction means against said brake disc so that said calculated tension coincides with siid reference tension.

DESCRIPTION OF THE PREFERRED EMBODIMENT OF THE INVENTION

Figure 1:
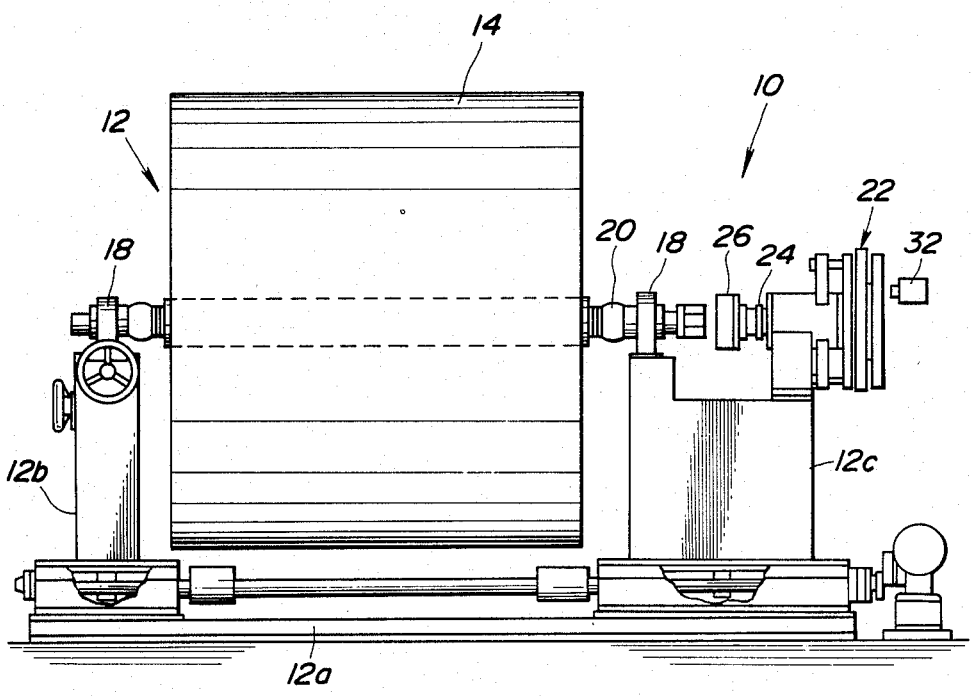
FIG. 1 is a front elevational view of a sheet tension control apparatus combined with a sheet reel and provided in accordance with the present invention.
Figure 2:
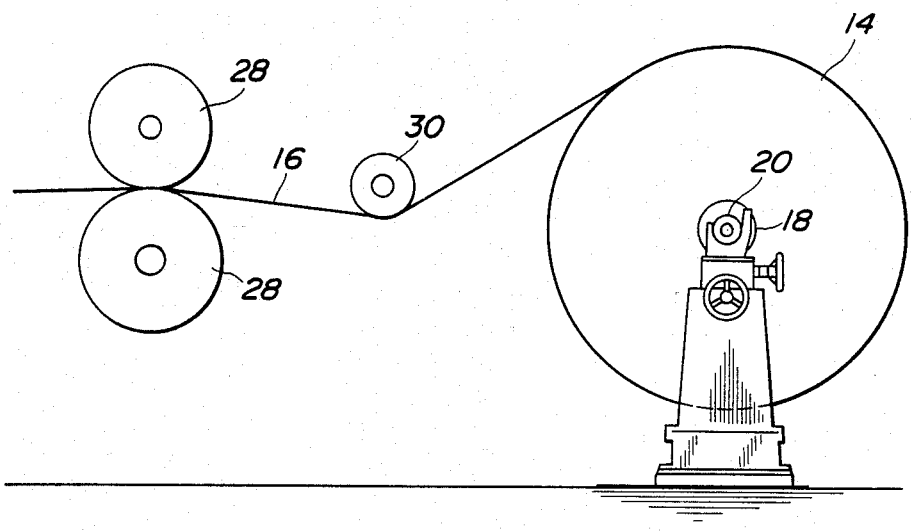
FIG. 2 is side-elevational view of the tension control apparatus.

A tension control apparatus 10 shown in FIGS. 1 and 2 is combined with a take-off reel 12 holding a roll 14 of sheet 16. The reel 12 comprises a base 12*a* and a pair of spaced mounting blocks 12*b* and 12*c* extending upwardly from the base 12*a*. A pair of bearings 18 and 18 are mounted on the upper end of the blocks 12*b* and 12*c*, and a shaft 20 of the reel 12 is rotatably supported by the pair of bearings 18 and 18. The roll 14 of sheet 16 is supported on the reel shaft 20.

Figure 3:
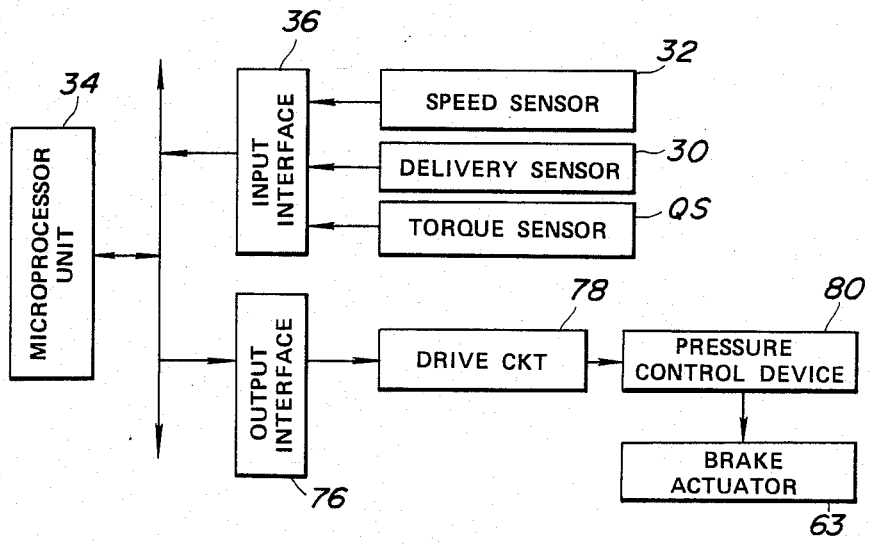
FIG. 3 is a block diagram of the tension control apparatus.

The tension control apparatus 10 comprises a brake device 22 which is mounted on the mounting block 12*c* and includes a brake shaft 24 adapted to be coupled with the coaxial reel shaft 20 through a clutch 26, mounted on one end of the brake shaft 24, for rotation therewith. The sheet 16 is held between a pair of pinch rolls 28 and 28 and is delivered or withdrawn from the reel 12, so that the sheet roll 14 is rotated together with the shaft 20. The amount of travel of the sheet 16, that is, the amount of delivery of the sheet from the reel 12, is measured by a delivery measuring sensor 30 ( FIG. 3) held in contact with the traveling sheet 16 for rotation, the delivery measuring sensor 30 here comprising a rotary transducer for outputting, for example, a pulse per 1 mm of travel of the sheet 16. The amount of travel of the sheet 16 may be measured through the measurement of the peripheral speed of the pinch rolls 28. The speed of rotation of the brake shaft 24, which is equal to the speed of rotation of the reel shaft 20, is measured by a rotational speed sensor 32 which comprises a rotary pulse generator for generating pulses in synchronism with the rotation of the brake shaft 24. The rotational speed sensor 32 may comprise any other suitable sensor such as a photosensor and a proximal switch. The respective detection signals are fed from the two sensors 30 and 32 to a microprocessor unit 34 via an input interface 36.

Figure 4:
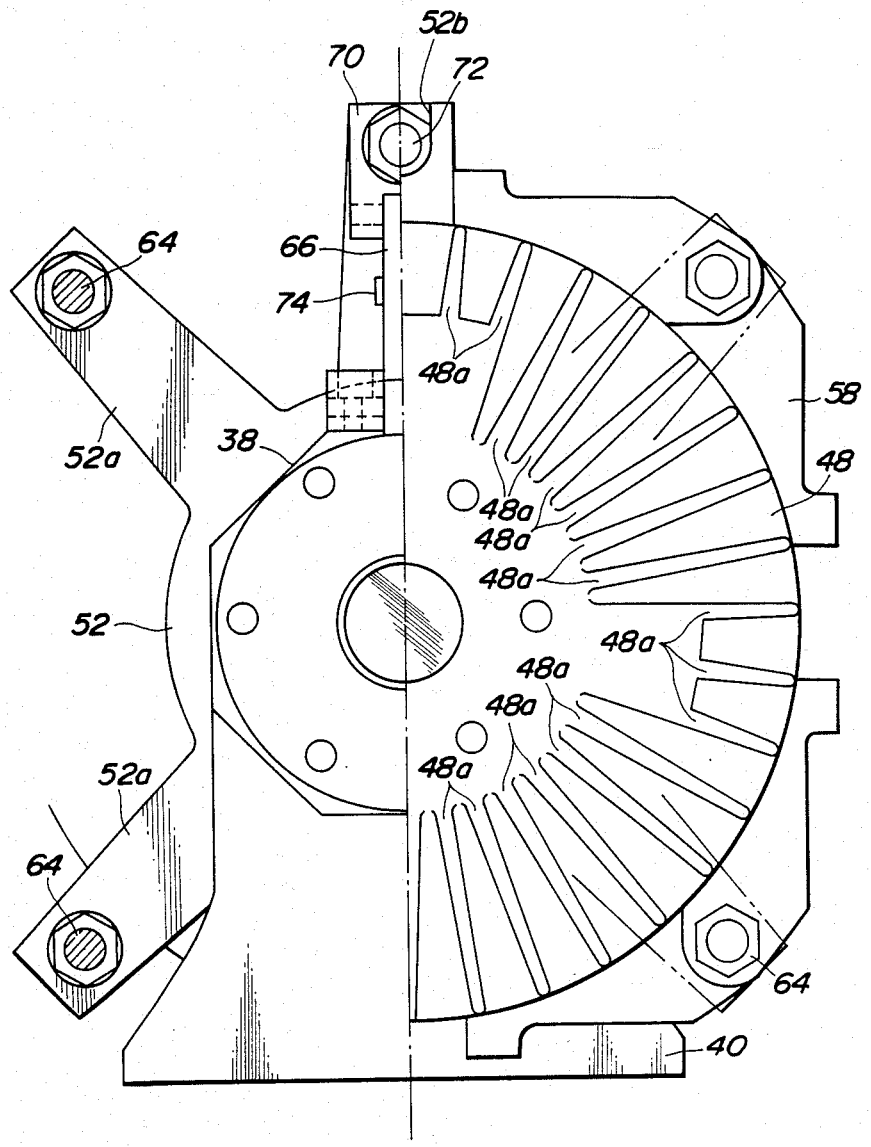
FIG. 4 is an end view of a brake device incorporated in the tension control apparatus, with parts shown in cross section.
Figure 5:
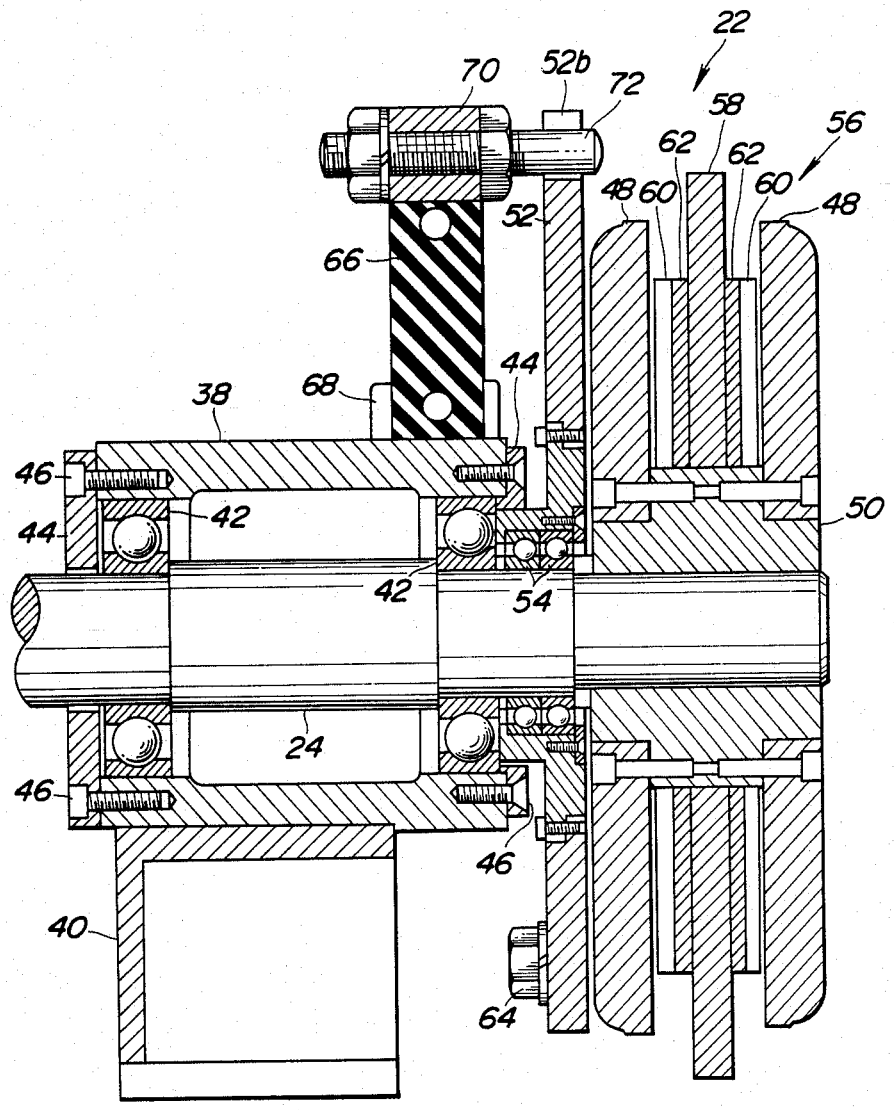
FIG. 5 is a cross-sectional view of the brake device.

As best shown in FIGS. 4 and 5, the brake device 22 of the pneumatic type comprises a hollow body 38 fixedly mounted on the mounting block 12*c* through a bracket 40, and a pair of spaced bearings 42 and 42 mounted within the body 38 at opposite ends thereof. The bearings 42 and 42 are held in position by a pair of retaining plates 44 and 44 secured to the opposite ends of the body 38 by bolts 46. The brake shaft 24 extends through the body 38 and is rotatably supported by the pair of bearings 42 and 42. A pair of brake discs 48 and 48 are fixedly mounted via a collar 50 on that portion of the brake shaft 24 extending exteriorly of the body 38 away from the clutch 26, so that the brake discs 48 and 48 are rotatable with the brake shaft 24. The brake discs 48 and 48 have radiator fins 48*a* on their one faces facing away from each other, as shown in FIG. 4. A connecting plate 52 is rotatably mounted on the brake shaft 24 through bearings 54 and disposed between the inner brake disc 48 and the body 38, the connecting plate 52 having a plurality of radially extending arms 52.

A friction assembly 56 is interposed between the pair of brake discs 48 and 48. The friction assembly 56 comprises a base plate 58 rotatably mounted on the brake shaft 24 and two pairs of friction pads 60, each pair of friction pads 60 being disposed on each side of the base plate 58 and the brake disc 48 facing it. Each friction pad 60 is carried by the base plate 58 through a collar 62 in such a manner that the friction pad 60 is only displaceable axially relative to the base plate 56 along the axis of the brake shaft 24. Urging means or brake actuator 63 in the form of pneumatic cylinder means incorporating piston means (not shown) is incorporated in the friction assembly 56, and upon application of pneumatic pressure to the pneumatic cylinder means via air conduits (not shown), each friction pad 60 is urged by the piston means against the brake disc 48 facing it, thereby applying a braking force to the brake shaft 24. The brake device 22 is one sold by Montalvo.

The base plate 58 is coupled to the connecting plate 52 by bolts 64 which pass through the radial arms 52*a* and the base plate 58 without interfering the brake disc 48 disposed therebetween. An elongated elastic member 66 serving as rotation limiting means is mounted on a top surface of the body 38 by a mounting member 68 and has a tubular support member 70 secured to its upper end. The connecting plate 52 has a notch 52*b* at its upper portion. A bolt 72 is passed through the support member 70 and the notch 52*b* of the connecting plate 52, so that the rotation or angular movement of the connecting plate 52 about the brake shaft 24 is limited by the bolt 72. When the brake actuator 63 is operated, the friction pads 60 on each side of the base plate 58 are urged into frictional engagement with the brake disc 48 facing them. Since the base plate 58 and the connecting plate 52 are prevented from rotation by the elastic member 66, the friction pads 60 apply a braking force to the rotating brake shaft 24 and hence to the shaft 20 of the reel 12. At this time, since the elastic member 66 serves to limit the rotation of the connecting plate 52 through the bolt 72, it is deformed in accordance with the torque of the shaft 20 of the reel 12 to produce a reaction force. Thus, the amount of deformation of the elastic member 66 represents the torque of the shaft 20. A plurality of strain gauges 74 are attached to the elastic member 66 and connected together to form an electrical bridge circuit in the well known manner for measuring the amount of deformation of the elastic member 66 to produce a measuring signal representative of the deformation amount or reaction force. Thus, the strain gauges 74 serve as a torque sensor QS. The measurement signal from the torque sensor QS is fed to the microprocessor unit 34 via the input interface 36. The measurement signals from the sheet delivery sensor 30, the rotational speed sensor 32 and the torque sensor QS are converted by the input interface 36 respectively into sheet delivery data representative of the amount of delivery of the sheet 16 from the roll 14, rotational speed data representative of the speed of rotation of the roll 14, and torque data representative of the torque of the brake shaft 24. The microprocessor unit 34 is programmed to be responsive to these three data to determine the optimum tension of the sheet 16 fed from the reel 14. The microprocessor unit 34 comprises a central processing unit (CPU) and an associated memory storing programs in accordance with which the CPU processes the data inputted thereinto as described below.

Figure 6:
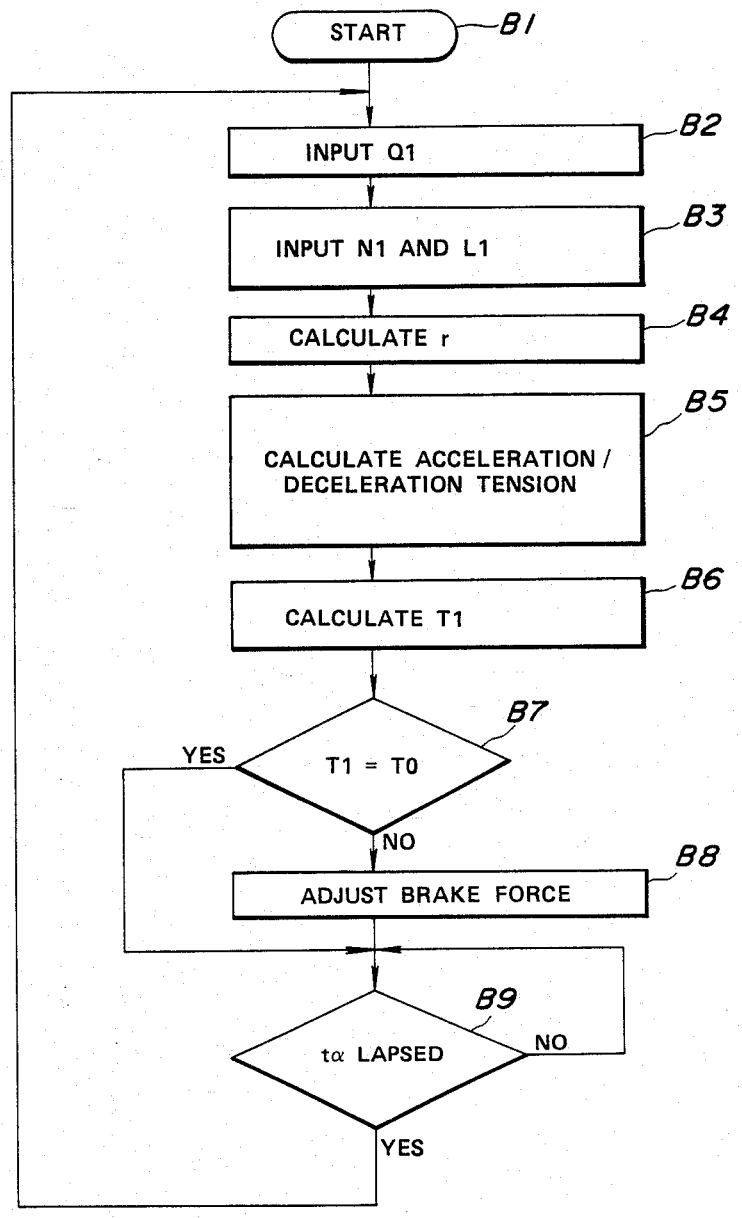
FIG. 6 is a flow chart of a program for carrying out the operation of the tension control apparatus.

The operation of the tension control apparatus 10 will now be described with reference to a flow chart (FIG. 6).

In Block B1, a processing is started. In Block B2, a central processing unit (CPU) of the microprocessor 34 inputs thereinto the torque data representative of torque Q1 of the brake shaft 24. In Block 3, the CPU inputs thereinto the sheet delivery data representative of the amount L1 of the sheet 16 from the roll 14 and the roll speed data representative of the rotational speed N1 of the roll 14. Then, in Block 4, the CPU calculates the radius r of the roll 14 from the sheet delivery data and the roll speed data. Then, the processing proceeds to Block 5 in which the CPU calculates a tension (acceleration/deceleration tension), resulting from the moment of inertia of the roll 14, from a difference between the rotational speed N1 and the rotational speed N0 obtained in the preceding processing. A program relating to the moment of inertia of the roll 14 is stored in the associated memory of the microprocessor unit 34. Then, in Block 6, the CPU calculates the overall tension T1 of the sheet 16 from the above data in accordance with a formula (2) below. Then, in Block 7, the CPU determines whether or not the tension T1 coincides with a reference tension T0. If the result is "NO", then the processing proceeds to Block 8. And, if the result is "YES", the processing proceeds to Block 9. More specifically, in Block 8, the microprocessor unit 34 outputs data or information representative of the difference between the values of the tensions T1 and T0. This output data is converted into an analog signal by an output interface 76 and fed to a drive ciruit 78. The drive circuit 78 outputs a signal, corresponding to the above tension difference, to a pressure control means 80. This pressure control means 80 includes a flow control valve to which a source of compressed air is connected,the flow control valve being also connected to the brake actuator or pneumatic cylinder 63. This flow control valve has an associated actuator for controlling a flow rate thereof. This actuator is responsive to the output signal from the drive circuit 78 to adjust the flow rate of the flow control valve to control the braking force applied by the brake device 22 to the reel shaft 20 in such a manner that the tensions T1 and T0 are brought into agreement with each other. In Block 9, the CPU determines whether a predetermined period ta of time has lapsed after the start of the processing, and if the result is "YES", the processing returns to Block 2 to repeat the above processing. Thus, the processing is repeated at predetermined intervals.

The tension T is obtained from the following formulas:

The torque Q exerted on the brake shaft 24 is represented by formula (1) below:

$$Q = T \cdot r \pm GD^2(N1-N2)/375\ t\alpha \qquad \ldots (1)$$

wherein Q is a torque (kgm) exerted on the shaft 24, r is the radius (m) of the roll 14, T is tension (kg) of the sheet 16, tα is the time (sec.) of acceleration or deceleration, (N1–N2) is the rotational speed (RPM) of the roll 14, and $GD^2$ is the moment (kg m) of inertia of the roll 14.

Therefore, formula (2) below is obtained from formula (1):

$$T=Q/r+GD^2(N1-N2)/375\mathrm{tr}\alpha \quad (2)$$

In the above formulas (1) and (2), the positive sign (+) is used when the acceleration of the sheet is encountered while the minus sign (−) is applied to the deceleration. The radius r of the roll 14 and the rotational speed difference (N1–N2) of the roll 14 are obtained in the following manner.

The relation between the amount L of delivery of the sheet 16 (i.e., the amount of travel of the sheet per unit time) detected by the sheet delivery sensor 30 and the rotational speed N of the roll 14 detected by the roll speed sensor 32 is represented by the following formula (3):

$$L=2\pi\mathrm{rN}\ldots \quad (3)$$

Therefore, the radius r of the roll 14 can be calculated from the amount L and the speed N.

As described above, with the tension controlling apparatus 10, the moment of inertia of the roll 14 is used as one of the data for controlling the tension of the sheet, so that the tension of the sheet is accurately controlled even when the sheet is subjected to considerable acceleration and deceleration.

What is claimed is:

1. An apparatus for controlling a tension of a sheet delivered from a rotatable sheet roll, said apparatus comprising:

(a) a brake device comprising a shaft connectable to the sheet roll for rotation therewith, a brake disc fixedly mounted on said shaft, and friction means rotatably mounted on said shaft;

(b) means for urging said friction means against said brake disc to apply a braking force thereto;

(c) an elastic member operatively connected to said friction means for limiting the rotation of said friction means and being deformable in accordance with a reaction force applied thereto when said friction means is urged against said brake disc;

(d) means for measuring a deformation of said elastic member to produce torque data representative of a torque exerted on said shaft;

(e) means for measuring a rotational speed of the sheet roll to produce rotation speed data representative of the rotational speed data;

(f) means for measuring the amount of delivery of the sheet from said sheet roll to produce sheet delivery data representative of the amount of delivery of the sheet;

(g) a microprocessor unit for calculating a radius of the roll from the rotation speed data and the sheet delivery data, said microprocessor unit calculating acceleration/deceleration of the roll from the speed data, said microprocessor unit calculating moment of inertia of the roll from the acceleration/deceleration of the roll, said microprocessor calculating a tension of the sheet from the torque data, the radius of the roll and the moment of inertia of the roll, said microprocessor unit being programmed to determine a difference between said calculated tension and a reference tension to output information representative of said tension difference; and (h) said urging means being responsive to said information to continuously adjust the urging of said friction means against said brake disc so that said calculated tension coincides with said reference tension.

2. An apparatus according to claim 1, in which said deformation measuring means comprises a strain gauge attached to said elastic member.

3. The apparatus of claim 1, wherein the tension of the sheet is calculated by the microprocessor in accordance with the following formula:

$$T=Q/r\mp GD^2(N1-N2)/375\ \mathrm{tr}\alpha$$

where T is the tension of the sheet in kg; Q is a torque in kgm exerted on the shaft; r is the radius of the roll; tα is the time in seconds of acceleration or deceleration (N1–N2) is the rotational speed in RPM of the roll; and $GD^2$ is the moment of inertia in kgm of the roll.

* * * * *